US008678162B2

(12) United States Patent
Aoji et al.

(10) Patent No.: US 8,678,162 B2
(45) Date of Patent: Mar. 25, 2014

(54) BILL HANDLING APPARATUS

(75) Inventors: Hirokazu Aoji, Owariasahi (JP); Sho Mizuno, Nagoya (JP); Masahiro Seguchi, Ohtsu (JP); Shuuji Tanaka, Nagakute (JP); Takeshi Kanagawa, Owariasahi (JP); Toru Yasueda, Kusatsu (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 243 days.

(21) Appl. No.: 12/954,113

(22) Filed: Nov. 24, 2010

(65) Prior Publication Data

US 2011/0130870 A1 Jun. 2, 2011

(30) Foreign Application Priority Data

Nov. 25, 2009 (JP) ..... 2009-267081

(51) Int. Cl.
*G07F 7/04* (2006.01)

(52) U.S. Cl.
USPC ..... 194/206; 194/344

(58) Field of Classification Search
USPC ..... 194/206, 207, 344, 350; 209/534; 235/379
See application file for complete search history.

(56) References Cited

U.S. PATENT DOCUMENTS

| | | | | |
|---|---|---|---|---|
| 4,479,049 | A * | 10/1984 | Hirose | 235/379 |
| 4,587,408 | A * | 5/1986 | Watanabe | 235/379 |
| 7,252,185 | B2 * | 8/2007 | Fujita et al. | 194/350 |
| 2004/0134839 | A1 * | 7/2004 | Kobayashi et al. | 209/534 |
| 2009/0107799 | A1 | 4/2009 | Kadowaki et al. | |

FOREIGN PATENT DOCUMENTS

| | | |
|---|---|---|
| JP | 08-221636 | 8/1996 |
| JP | 11-339102 | 12/1999 |
| JP | 2000-163634 | 6/2000 |
| JP | 2000-172903 | 6/2000 |
| JP | 2003-272027 | 9/2003 |
| JP | 2008-093975 | 4/2008 |
| JP | 2008-217465 | 9/2008 |
| JP | 2009-110230 | 5/2009 |

OTHER PUBLICATIONS

Japan Patent Office Notification of Reasons for Refusal on application 2009-267081 dated Jul. 9, 2013; 2 pages.
USPTO Non-final office Action on U.S. Appl. No. 13/752,912 mailed May 24, 2013; 10 pages.

* cited by examiner

*Primary Examiner* — Mark Beauchaine
(74) *Attorney, Agent, or Firm* — Foley & Lardner LLP

(57) ABSTRACT

A bill handling apparatus includes: a first loop-like conveying path that includes a bill discriminating unit, is connected to a bill receiving and dispensing port and a temporary storage unit, and connected to a plurality of loading boxes to convey bills in two directions; a second conveying path connected to the loading box to convey bills in two directions; a first gate that connects the first conveying path with the second conveying path and switches a conveying direction of the conveying path that conveys bills; and a controller that controls switching of the first gate and conveyance of the conveying path. The controller controls the bills conveyed to the first conveying path in one of the two directions to be conveyed to the loading box through the second conveying path via the first gate, and the bills conveyed from the loading box through the second conveying path to be conveyed to the first conveying path in one of the two directions via the first gate.

9 Claims, 19 Drawing Sheets

BILL HANDLING APPARATUS

CLAIM OF PRIORITY

The present application claims priority from Japanese application JP 2009-267081 filed on Nov. 25, 2009, the content of which is hereby incorporated by reference into this application.

FIELD OF THE INVENTION

The present invention relates to a bill handling apparatus that is mounted on and used in ATMs (Automatic Teller Machine) automatically receiving and dispensing bills by operation of users.

BACKGROUND OF THE INVENTION

Recently, according to an increase in kinds of denomination values and an increase in storage capacity of bills that ATMs handle, bill handling apparatuses equipped with as many large bill boxes as possible have been proposed. For example, JP-A-H8 (1996)-221636 and JP-A-2009-110230 disclose bill handling apparatuses in which a plurality of bill boxes is arranged side by side at the lower part of the apparatus and the other components are collectively arranged in the upper part of the apparatus.

In the bill handling apparatus disclosed in JP-A-H8 (1996)-221636, a bill receiving and dispensing port, a bill discriminating unit, and a temporary storage unit are arranged in the upper part of the apparatus, while a longitudinal loading box and a plurality of bill storage boxes are arranged from the front to the rear in the lower part. The components are connected by a one-way conveying path. The conveying path of the one-way conveying path will be complicated. In particular, since it is necessary to convey received bills and bills to be dispensed in the same direction inside the bill discriminating unit, an exclusive conveying path for always conveying the bills to the inlet of the bill discriminating unit is required. That is, the bill receiving and dispensing port and the temporary storage unit are arranged in one loop-like conveying route connected to the bill discriminating unit while the bill storage box is arranged in another loop-like conveying route connected to the bill discriminating unit. Therefore, there are disadvantages that the volume of structure forming the conveying path increases relative to the entire apparatus and the size of the bill storage box decreases relative to the size of the entire apparatus.

In the bill handling apparatus disclosed in JP-A-2009-110230, a bill receiving and dispensing port is arranged on the front of the upper part of the apparatus, a temporary storage unit and a bill discriminating unit are arranged side by side in behind the bill receiving and dispensing port, a loading box, a reject box, and a bill storage box are arranged longitudinally side by side, and the components are connected to a two-way conveying path.

Further, according to the bill handling apparatus disclosed in JP-A-2000-172903, the components are connected to a two-way conveying path to reduce the conveying path, similar to the bill handling apparatus disclosed in JP-A-2009-110230. For example, in FIG. 27 (second embodiment), a temporary storage box 40, a reject box 65, and a bill loading and collecting box 83 are arranged in the rear part of the apparatus, the rejection box 65 that functions as a receiving box stores non-return bills and bill left behind from the temporary storage box 40 in receiving bills, and stores bills rejected from the temporary storage box 40 in dispensing bills.

In the bill handling apparatus disclosed in JP-A-2000-172903, the bills fed from the temporary storage box 40 cannot be collected to the reject box and necessarily stored in the recycle box, even if bills not conveyed are detected after passing the bill discriminating unit. Therefore, failure in stacking the bills may be caused in the bills in the recycle box and problems in conveyance, such as jam, may be generated in feeding bills from the recycle box at the next time.

In the bill handling apparatus disclosed in JP-A-2009-110230, since a mechanism to switch between the reject box and the loading box is provided, it is possible to prevent problems in conveying bills after the bills pass the bill discriminating unit, which may be generated in JP-A-2000-172903. However, the apparatus disclosed in JP-A-2009-110230 requires an exclusive conveying path 56 for conveying bills from the loading box to the bill discriminating unit, which make the conveying path complicated. Further, in this configuration, it is required to implement a three-story conveying path composed of two two-way conveying paths 51*b* and 58 and one one-way conveying path 55 between the bottom of the temporary storage unit and the top of the recycle box, such that it is difficult to reduce the height of the apparatus, and both achieve a compact apparatus and increase the capacity of the recycle box.

SUMMARY OF THE INVENTION

It is an object of the present invention to achieve a simple bill conveying mechanism and a compact apparatus by making the conveying path of bills as short as possible.

According to an aspect of the present invention, there is provided a bill handling apparatus for handling received and dispensed bills, including: a bill receiving and dispensing port that receives bills for receipt and accumulates bills discharged for dispensing; a bill discriminating unit that discriminates truth and denominations of the received and dispensed bills; a temporary storage unit that is arranged in a conveying path and temporarily stores bills discriminated by the bill discriminating unit; a plurality of bill storage boxes that is arranged in the conveying path and stores bills; a loading box that is arranged in the conveying path and stores bills that are added to the bill storage boxes or collects and stores bills conveyed from the bill storage boxes; a first loop-like conveying path that includes the bill discriminating unit, is connected to the bill receiving and dispensing port and the temporary storage unit, and connected to the plurality of loading boxes to convey bills in two directions; a second conveying path connected to the loading box to convey bills in two directions; a first gate that connects the first conveying path with the second conveying path and switches a conveying direction of the conveying path that conveys bills; and a controller that controls at least switching of the first gate and conveyance of the conveying path, in which the controller controls the bills conveyed to the first conveying path in one of the two directions to be conveyed to the loading box through the second conveying path via the first gate and controls the bills conveyed from the loading box through the second conveying path to be conveyed on the first conveying path in one of the two directions via the first gate.

The bill handling apparatus may include: a reject box that stores bills discriminated to be rejected by the bill discriminating unit (rejected bills); and a second gate that switches a conveying destination of the second conveying path to convey bills to one of the reject box and the loading box, in which the rejected bills conveyed to the first conveying path are conveyed to the gate and the second conveying path, and conveyed to the reject box via the second gate.

Further, in the bill handling apparatus, the first conveying path may be branched by the gate to be connected to the bill receiving and dispensing port, at one side of the bill discriminating unit, branched by the gate to be connected to the temporary storage unit, and then connected to the second conveying path via the first gate.

Further, the bill handling apparatus may further include another bill storage box connected to the second conveying path and arranged side by side with the loading box.

Further, in the bill handling apparatus, the controller may control bills fed from the bill storage boxes to be conveyed to the loading box through the first gate and the second conveying path, without storing the bills to the temporary storage unit, after passing the bill discriminating unit in the first conveying path, bills fed from the loading box to the second conveying path to be conveyed to the first conveying path via the first gate, and conveyed to the plurality of bill storage boxes, without storing the bills to the temporary storage unit, after passing the bill discriminating unit.

Further, the bill handling apparatus may include: a first dispensing route for discharging bills fed from the bill storage boxes to the bill receiving and dispensing port through the bill discriminating unit by conveying the bills on the first conveying path in one of the two directions; and a second dispensing route for discharging bills fed from the loading portion to the second conveying path to the bill receiving and dispensing port through the bill discriminating unit by conveying the bills on the first conveying path in the other of the two directions via the first gate, not through the conveying path part connected with the loading box.

Further, the bill handling apparatus may include a tray accommodating the loading box arranged in a rear side of the apparatus and the plurality of bill storage boxes arranged ahead of the loading box, in which the tray may be drawn backward from the apparatus by separating the second conveying path from the first conveying path.

Further, the bill handling apparatus may include a plurality of detecting sensors that are arranged at least in the first conveying path and detects a conveying state of bills, in which the controller monitors detection signals from the detecting sensor and controls to determine a problem in conveying the bills on the first conveying path and select the first dispensing route or the second dispensing route in accordance with the determination result.

According to the present invention, it is possible to reduce the entire length of the bill conveying path and simplify the bill conveying mechanism.

DETAILED DESCRIPTION OF THE PREFERRED EMBODIMENTS

Hereinafter, an embodiment of the present invention is described with reference to the accompanying drawings.

Figure 1:
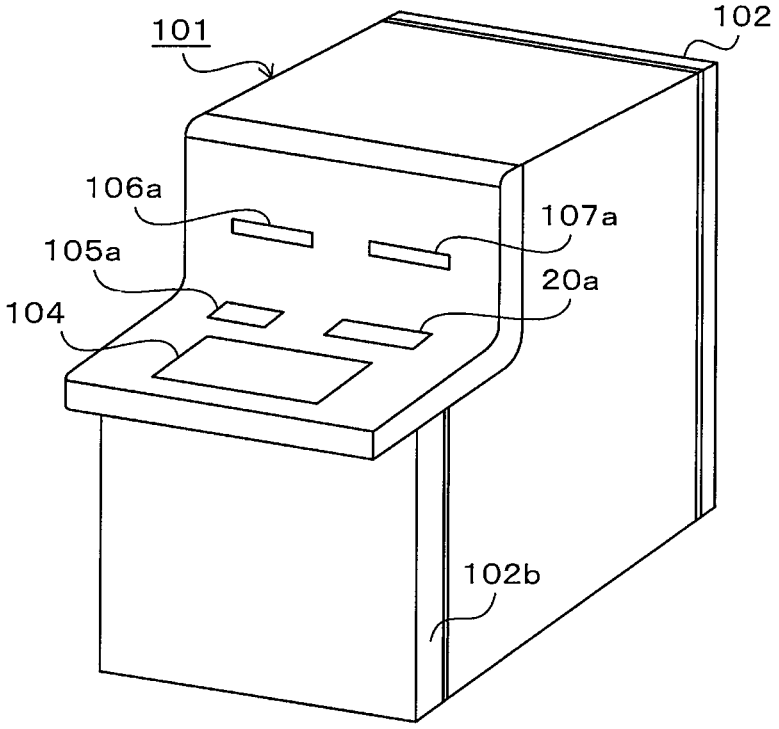
FIG. 1 is a perspective view showing the external appearance of an ATM.
Figure 2:
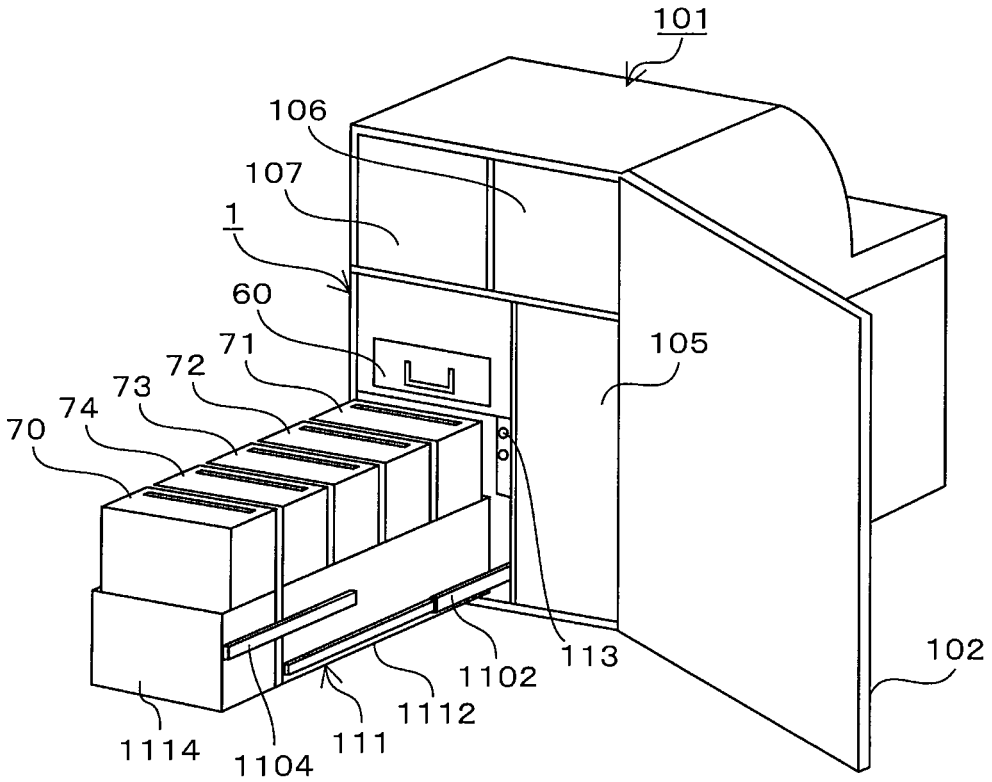
FIG. 2 is a perspective view of the rear side of the ATM.

FIG. 1 is a view showing the external appearance of an ATM equipped with a bill handling apparatus and FIG. 2 is a view showing the rear side of the bill handling apparatus.

The ATM 101 uses a card, bills, and a detailed statement as transaction media and performs processes, such as deposit, payment, and transfer by operation of users. A bankbook processing mechanism 106 that processes a user's bankbook and prints and discharges a transaction detailed statement and a card and statement processing mechanism 107 that processes a user's cards and prints and discharges a transaction detailed statement are provided at the upper part of the ATM 101. The bankbook processing mechanism 106 processes a user's bankbook inserted through a slot 106*a*, and prints and discharges a transaction detailed statement. The card and statement processing mechanism 107 processes a user's card inserted through a slot 107*a*, and prints and discharges a transaction detailed statement. An operation portion 104 for displaying contents of a transaction of a user and inputting a variety of information or items for the transaction is provided at the front part of the front side of the ATM.

A bill handling apparatus 1 that processes bills is provided at the right side of the lower part of the ATM 101 and a coin processing apparatus 105 that processes coins is provided at the left side (see FIG. 2). Bills are received and dispensed by opening/closing a shutter 20*a* mounted in a bill receiving and dispensing port 20 of the bill handling apparatus 1. Similarly, receiving and dispensing transaction of coins is performed by opening/closing a shutter 105*a* mounted in a receiving and dispensing port of the coil processing apparatus 105. Further, the ATM 101 may not be provided with the coin processing apparatus 105.

Figure 3:
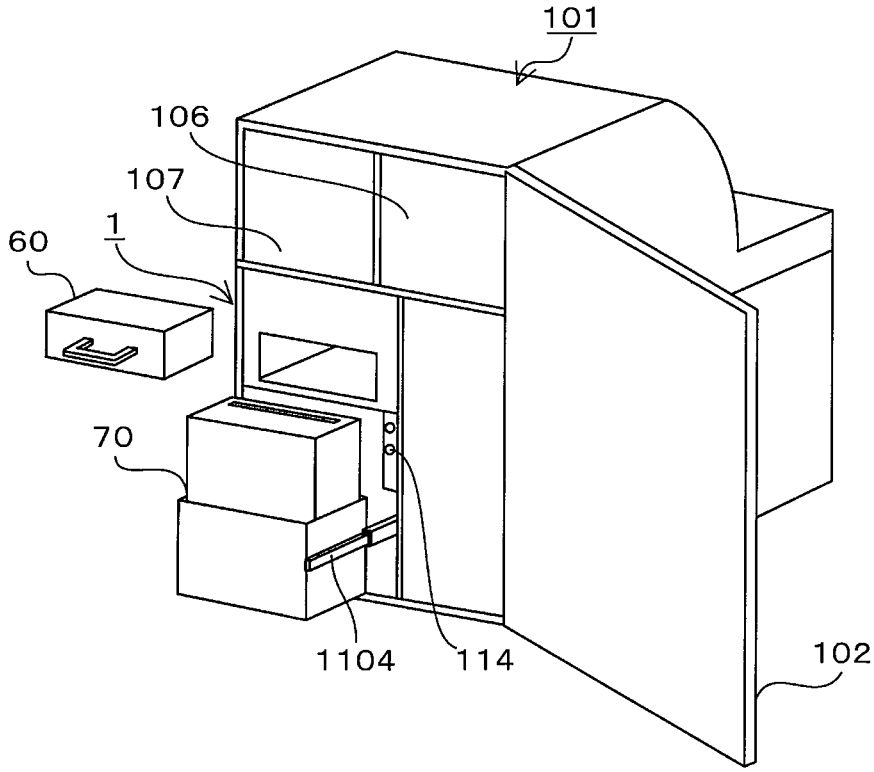
FIG. 3 is a perspective view of the rear side of the ATM.
Figure 15:
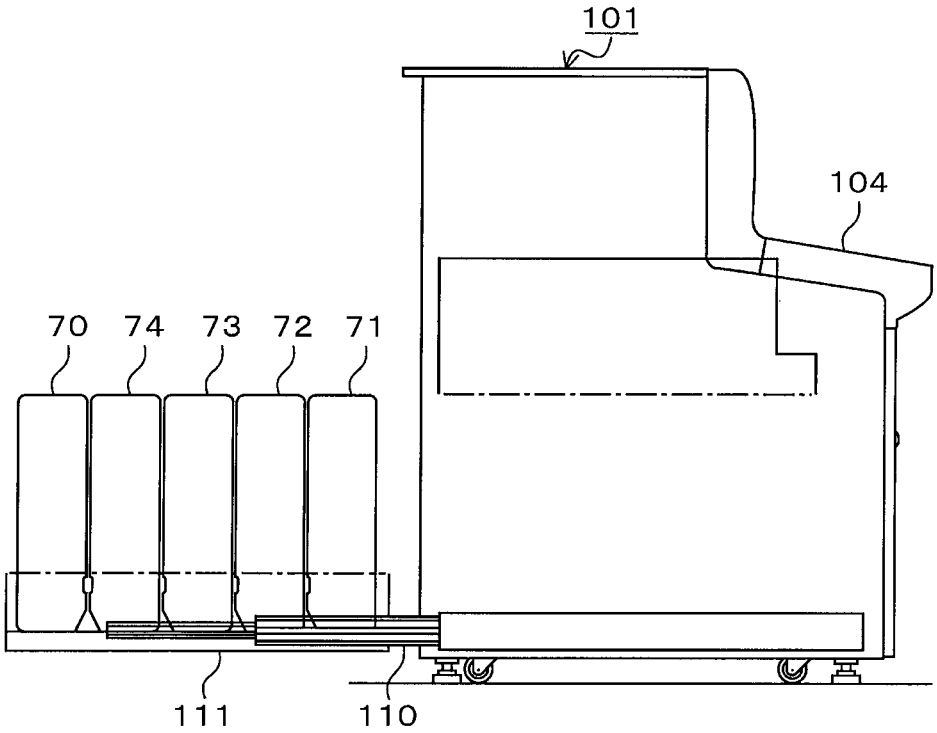
FIG. 15 is a side view of an ATM equipped with the bill handling apparatus.

FIGS. 2 and 3 are rear views of the ATM, with a rear door 102 open. A loading box 70 and a plurality of bill storage boxes 74 to 71 are detachably mounted on a tray 111, in a line forward from the rear side of the ATM (also see FIG. 15). The tray 111 can be divided into a first tray 1112 where the plurality of bill storage boxes 74 to 71 are mounted and a second tray 1114 where the loading box 70 is mounted, and the entire tray 111 can be drawn backward from the rear side while being supported by a rail 1102, with the first tray 1112 and the second tray 1114 combined. Meanwhile, it is possible to draw only the second tray 1114 supported by a rail 1104 backward from the rear side, with the first tray 1112 fixed.

In this configuration, an actuator is mounted in each of the rails 1102 and 1104 and corresponding actuators are operated by operating switches 113 and 114 to lock or release the rails. That is, when the switch 113 is not operated, the actuator in the rail 1104 is kept locked and the first tray 1112 and the second tray 1114 are combined. As the switch 113 is operated in this state, the entire tray 111 is drawn backward while being supported by the rail 1102. On the other hand, when only the switch 113 is operated without operating the switch 114, only the second tray 1114 is drawn backward while being supported by the rail 1104. In this case, it is possible to detach only the loading box 70. Therefore, it is possible to load/collect bills to/from the plurality of bill receiving boxes 74 to 71 from the loading box 70, without stopping the operation of the ATM 101. Further, as a modified example, it may be possible to mount all of the loading box 70 and the plurality of bill receiving boxes 71 to 74 to the first tray without installing the second tray.

The reject box 60 also has a mechanism for detachably attaching to the rear side of the bill handling apparatus 1.

Figure 4:
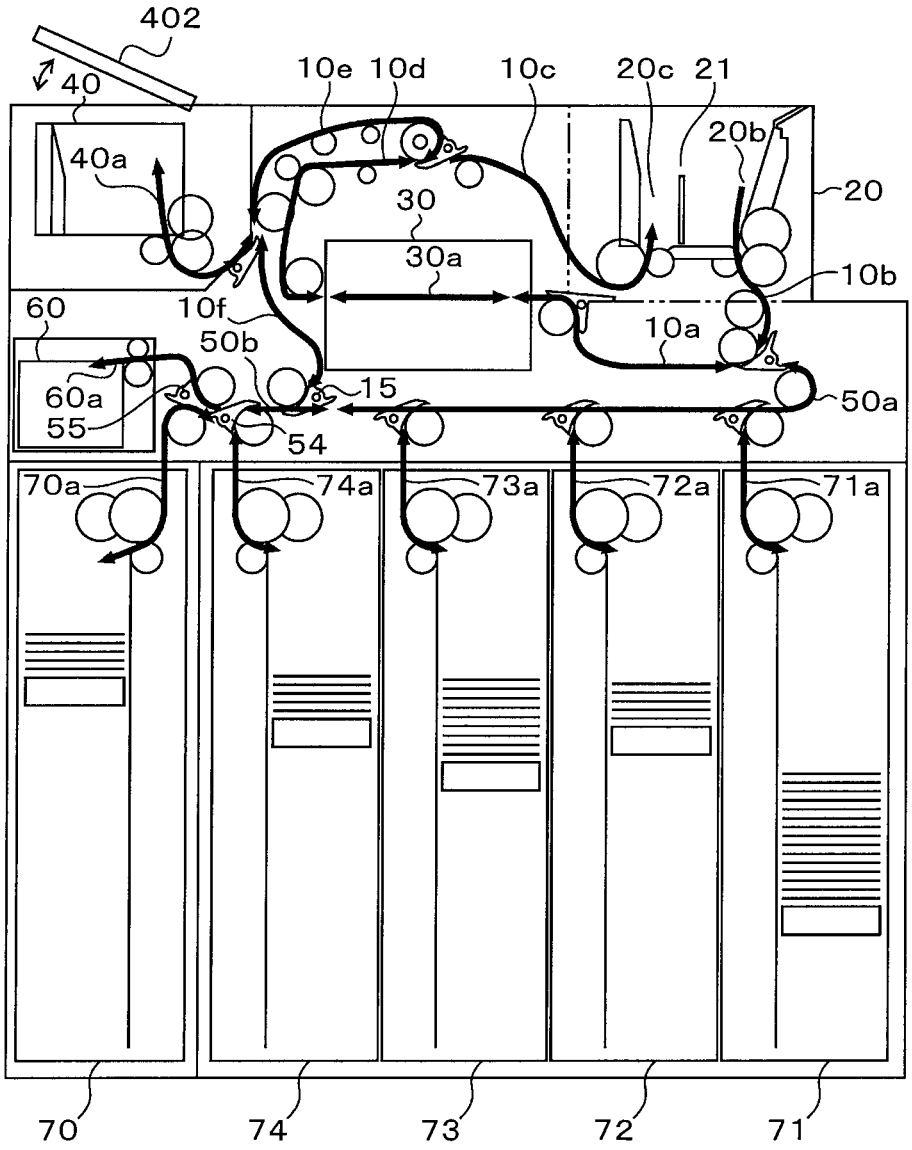
FIG. 4 is a side view illustrating the configuration of the bill handling apparatus according to an embodiment of the present invention.

FIG. 4 is a side view showing the internal configuration of the bill handling apparatus.

A mechanism for processing transacted bills is arranged in the upper part of the bill handling apparatus 1 and a bill receiving mechanism is arranged in the lower part.

The bill receiving and dispensing port 20 that allows users to input and extract bills is arranged in the front side (the side facing the users: upper right side in FIG. 4), in the upper part of the bill handling apparatus 1. Further, a bill discriminating unit 30 that discriminates bills is arranged in the middle part and a temporary storage unit 40 that temporarily stores bills that the users input until the transaction is finished is arranged in the upper end of the rear part. A reject box 60 that stores bills not relating to the receiving or dispensing transaction or bills that the customer forgot to extract is arranged under the temporary storage unit 40. These components are connected by a two-way conveying path.

In this configuration, the bill discriminating unit 30 can discriminate the denominations and the truth of the bills, regardless whether the bills are conveyed from the front to the rear or conveyed from the rear to the front. That is, the bill discriminating unit 30 can discriminate the denominations and the truth of bills conveyed in two directions, and can discriminate whether the bills should be rejected.

In the bill receiving and dispensing port 20, a bill feeding portion 20*b* fed down the bills which have been inputted from above and a bill accumulating portion 20*c* accumulating bills for dispensing or returning which are conveyed upward are arranged in the front-rear direction.

Further, a door 402 that can be opened/closed is arranged in the upper part of the temporary storage unit 40. The door 402 is closed in the normal state, but when the operation of the ATM is stopped by an unexpected power failure or a breakdown, an attendant can see or easily remove the bills existing in the temporary storage unit 40 by opening the door 402.

In the lower part of the bill handling apparatus 1, the bill storage boxes 71 to 74 for storing received bills separately in respective denominations arranged backward from the front and the loading box 70 that loads and collects the bills in the bill storage and functions as a bill loading portion are mounted on the tray 111. Further, the bill storage box 74 may be used as the reject box that stores bills not relating to the receiving or dispensing transaction. Bill conveying paths 70*a*, 71*a* to 74*a* are formed through the inlets and outlets of the loading box 70 and the bill storage boxes 71 to 74.

Therefore, the temporary storage unit 40, the rejection box 60, and the loading box 70 are arranged from above at the rear part of the apparatus. Further, the operations of the components, for example, operating rollers for the conveying path and switching a bill distribution gate of the conveying path, are controlled and operated by a controller (not shown).

In the conveying paths, the conveying paths 10*a*, 10*b*, 10*d* to 10*f*, 40*a*, 50*a*, and 50*b* form a two-way conveying path and the direction indicated by arrows shows the conveying direction of bills. Assume in this configuration that the two-way conveying paths 10*a*, 30*a*, 10*d*, 10*e*, 10*f*, and 50*a* between the bill receiving and dispensing port 20 and the storage boxes 71 to 73 are the first conveying path and the two-way conveying path 50*b* is the second conveying path. That is, the bill receiving and dispensing port 20, the temporary storage unit 40, and the bill storage boxes 71 to 73 are connected in the first conveying path and the storage box 74 is connected to the left end of the second conveying path 50*b* by the bill distribution gate 54. Further, the loading box 70 and the reject box 60 are switched to the connected to the second conveying path 50*b* by the bill distribution gates 54 and 55.

The first conveying path, a two-way conveying path, conveys bills in a first conveying direction, that is, counterclockwise (left rotation in FIG. 4) and a second conveying direction, that is, clockwise (right rotation in FIG. 4). Further, the second conveying path 50*b*, which is a two-way conveying path, conveys bills from the bill storage box 74, the loading box 70, and the reject box 60 to the bill distribution gate 15, which is a first conveying path, and from the bill distribution gate 15 to the bill storage box 74, the loading box 70, and the reject box 60, which is a second conveying direction.

In the first conveying path connected to the bill discriminating unit 30, the ends of the conveying path (the lower end of the conveying path 10*f* and the left end of the conveying path 50*a*) are connected to the right end of the second conveying path 50*b* by the bill distribution gate 15, even if the bills are conveyed in any direction.

Further, each component including the conveying paths is provided with a driving motor that operates the conveying path, an electromagnetic solenoid that switches the bill distribution gates for switching the conveying paths, and a detecting sensor (not shown) that detects that bills are conveyed, such that corresponding driving motors or electromagnetic solenoids are operated in accordance with transaction of bills and the conveying state of bills is monitored by detection signals from the detecting sensor.

Figure 17:
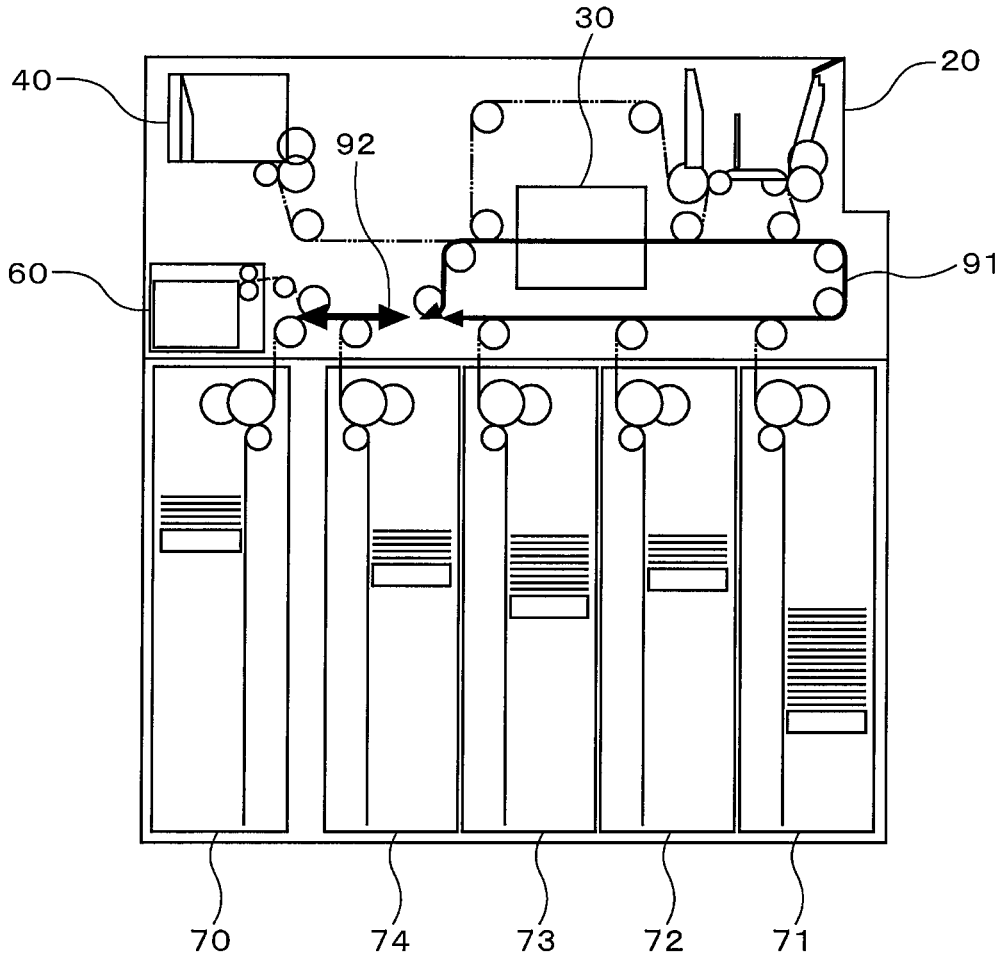
FIG. 17 is a side view illustrating the configuration of the bill handling apparatus.

FIG. 17 can be achieved from FIG. 4 showing the conveying direction of bills. That is, the loop-like first conveying path 91 (50*a*, 10*a*, 30*a*, 10*d*, 10*e*, and 10*f* in FIG. 4) conveys bills in two directions, counterclockwise (left rotation in FIG. 4: first conveying direction) and clockwise (right rotation in FIG. 4: second conveying direction). Further, the straight second conveying path 92 (50*b* in FIG. 4) conveys bills to the left and right (two directions). The plurality of bill storage boxes 60, 70, and 71 to 74 can be arranged under the first and second conveying paths, and the arrangement and function of the storage box may be modified, which correspond to various embodiments.

Although the first conveying path 91 has a loop shape in this configuration, the bills are conveyed in two directions by connection with the second conveying path, not conveyed and circulating on the first conveying path.

Figure 18:
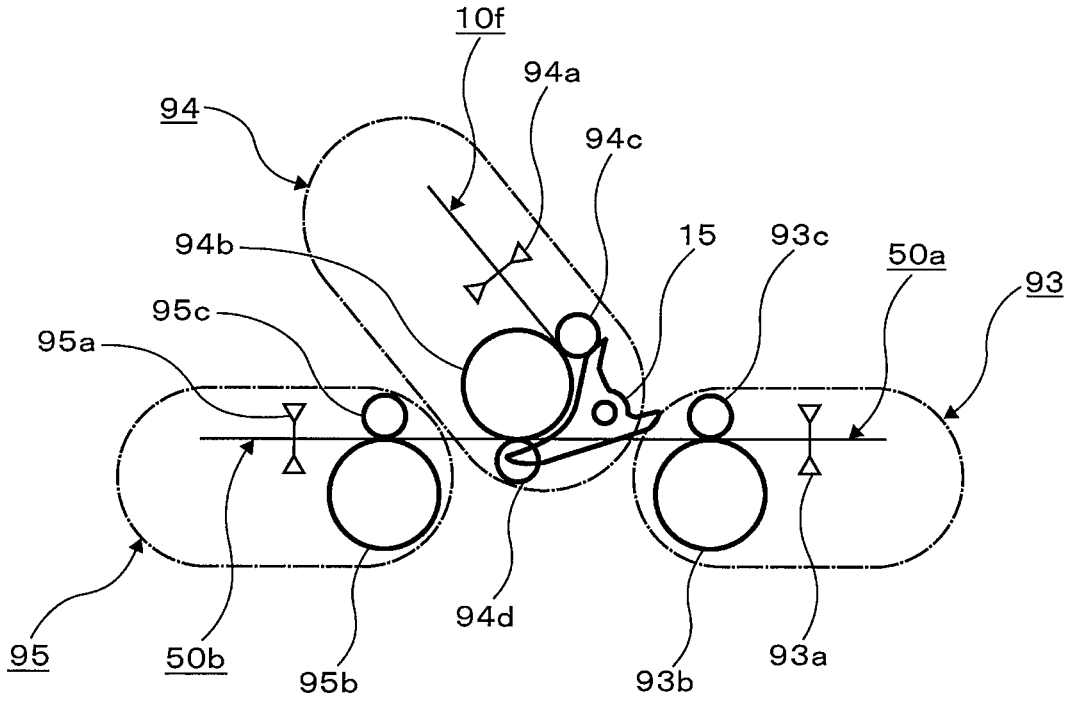
FIG. 18 is a side view showing a conveying path switching mechanism in the bill handling apparatus.

Next, a mechanism for the joint of the first conveying path 91 and the second conveying path 92 is described with reference to FIG. 18. Three conveying paths, the conveying path 50*a*, conveying path 10*f*, and conveying path 50*b*, are connected at the joint (herein, the conveying paths indicated the conveying paths 93, 94 and 95). The conveying paths 93 to 95 have detecting sensors 93*a* to 95*a*, conveying rollers 93*b* to 95*b*, and pressing rollers 93*c*, 95*c*, and 94*d*, respectively. The bill distribution gate 15 is arranged at the joint, such that two-way conveying between the conveying path 93 and the conveying path 95 and two-way conveying between the conveying path 94 and the conveying path 95 are possible to appropriately switching the bill distribution gate 15. Any conveyance allows the two-way conveyance between the first conveying path 93 or 94 and the second conveying path 95, but circulation and conveyance in the first conveying path 93 are impossible.

Figure 16:
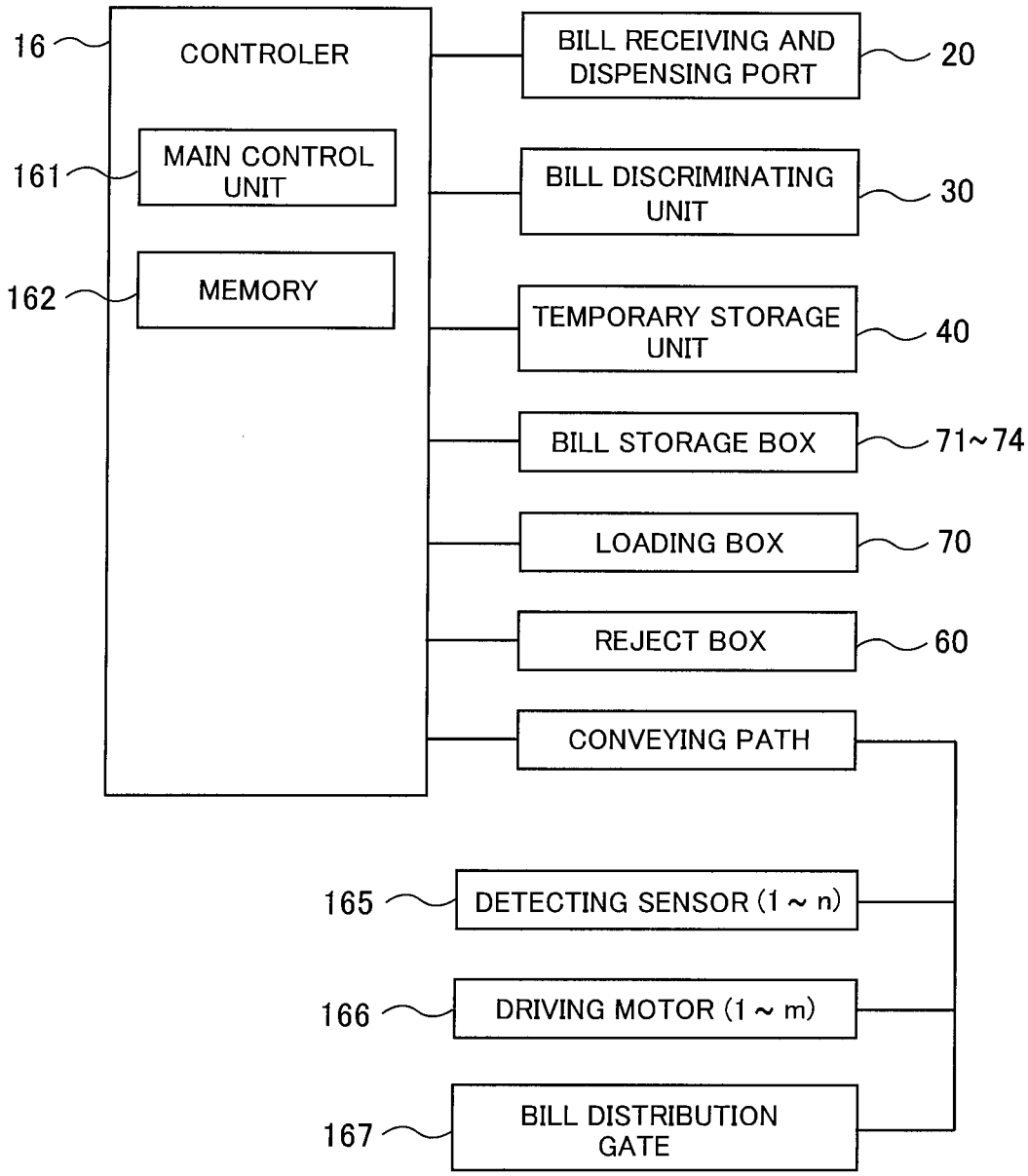
FIG. 16 is a control block diagram of the bill handling apparatus.

FIG. 16 shows a control block of the bill handling apparatus.

The bill handling apparatus 1 includes the bill receiving and dispensing port 20, the bill discriminating unit 30, the temporary storage unit 40, the bill storage boxes 71 to 74, the reject box 60, the loading box 70, the conveying paths 10*a* to 10*f*, 50*a*, and 50*b* (hereafter, indicated by a representative reference numeral, 10), and a controller 16 controlling the components. The controller 16 has a main control unit 161, which is a microprocessor for control and a memory 162. In particular, this embodiment is provided with n detecting sensors 165 that detect that bills are conveyed, m driving motors 166 that operate the conveying path 10, and a bill distribution gate 167 that switches the conveying path 10, which are arranged in the conveying path 10. The main control unit 161 of the controller 16 monitors detection signals from the detecting sensor 165 and detects that passage of bills or problems in conveyance while operating the driving motor 166 to rotate in normal and reverse directions and controls conveyance of the bills in the normal and reverse directions. Further, it controls switching of the bill distribution gate, switches the conveying path that conveys the bills, or switches the storage destination of the bills.

Receiving and dispensing bills, adding bills, collecting bills, and collecting bills left behind can be performed by the bill handling apparatus 1 having this configuration. The operations are described hereafter.

The operation of a receipt transaction process in the bill handling apparatus 1 is described with reference to FIG. 5.

Receipt transaction is a receipt counting process for performing truth discrimination, denomination discrimination, and counting of bills input to the bill feeding portion 20*b* of the bill receiving and dispensing port 20, as a main process.

First, the plurality of bills set in the bill feeding portion 20*b* of the bill receiving and dispensing port 20 are separated one by one and fed down on the conveying path 10*b*. The bills fed on the conveying path 10*b* passes through the conveying path 30*a* in the bill discriminating unit 30 from the front side to the rear side by the conveying path 10*a*. The bill discriminating unit 30 acquires images of the passing bills, using the sensor mounted therein, and discriminates the truth, denominations, and normal and damaged states of the bills.

The bills passing through the bill discriminating unit 30 are once conveyed upward from the rear part of the bill discriminating unit 30 by the conveying path 10*d*. The discrimination by the bill discriminating unit 30 is completed while the bills are conveyed by the conveying path 10*d*, and switching of the bill distribution gate 13 is executed according to a result of the discrimination. That is, when the bill discriminating unit 30 discriminates that the bills are acceptable bills, the bill distribution gate 13 is switched to be connected to the conveying path 10*e* and the bill is conveyed by the conveying paths 10*e* and 40*a* and temporarily accumulated in the temporary storage unit 40. Meanwhile, when the bill discriminating unit 30 discriminates that the bills are unacceptable bills, the bill distribution gate 13 is switched to be connected to the conveying path 10*c* and the bill is fed back and accumulated in the bill accumulating portion 20*c*, and then returned to the user.

In the receipt counting process described above, the first conveying path conveys the bills in the first conveying direction sequentially through the conveying paths 10*a*, 30*a*, 10*d*, and 10*e*.

All bills inputted to the bill receiving and dispensing port 20 are processed in this way, and the bills which are temporarily stored in the temporary storage unit 40 are conveyed to the bill storage boxes 71 to 74 and stored (receipt storage process) when a received amount and an amount counted by the bill handling device 1 coincide with each other and the user inputs an instruction for deciding the receipt transaction through the customer operation portion 104.

Further, controlling of the operation such as starting or stopping the conveyance of bills on the conveying paths, changing the conveying direction, and switching the gate are performed by the controller (not shown) (the same in the following description).

Figure 6:
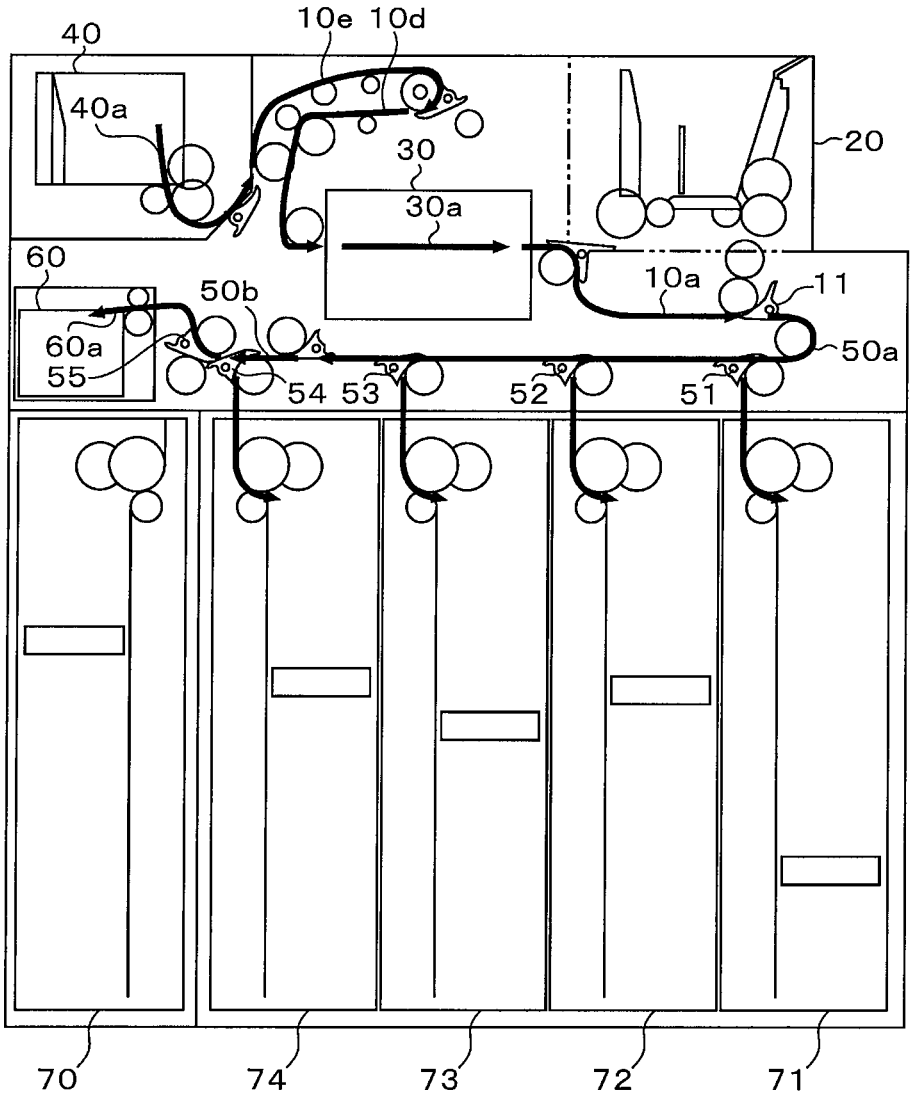
FIG. 6 is a view illustrating the operation of a receipt storage process in the bill handling apparatus.

Next, the operation of a receipt process is described with reference to FIG. 6.

In the storage process, the bill distribution gate 13 is switched to be connected to the temporary storage unit 40 and the bill discriminating unit 30 while the bill distribution gate 11 is switched to be connected to the conveying path 10*a* and the conveying path 50*a*.

The bills fed one by one from the temporary storage unit 40 are conveyed to the bill discriminating unit 30 through the conveying paths 40*a*, 10*e*, and 10*d*. The bills having passed through the bill discriminating unit 30 are conveyed by the conveying path 10*a* and conveyed downward by the bill distribution gate 11 through the conveying path 50*a*. Further, the bills are conveyed by the conveying paths 50*a*, and 50*b*, the bill distribution gates 51 to 55 are switched in accordance with the denominations of bills which are discriminated by the bill discriminating unit 30, and the bills are stored in any one of the loading box 70 or the bill storage boxes 71 to 74. Further, the bills may be stored in the loading box 70.

In this operation, when the bill discriminating unit 30 discriminates that the bills are unacceptable bills, the bill distribution gates 54 and 55 are switched to be connected to the conveying path 60*a* and the bills are stored in the reject box 60. Further, the reject box 60 may be used as a collecting box for storing the bills that the customer forgot to extract, in which the bill storage box 74 is used as the reject box.

In storing the bills fed from the temporary storage unit 40, the loading box 70 not only functions as a loading box but can be used as a bill storage box, by arranging the bill distribution gate 55 after passed through the bill discriminating unit 30.

As described above, in the receipt storage process, the conveying paths 10*e*, 10*d*, 30*a*, 10*a*, and 50*a* of the first conveying path and the second conveying path 50*b* operate to convey the bills in the second conveying direction (reverse to the first conveying direction).

Next, the operation of a dispensing transaction process is described with reference to FIG. 7.

In the dispensing transaction process, the bills stored in accordance with the denominations are fed one by one from the bill storage boxes 71 to 73 and conveyed to the bill discriminating unit 30 by the conveying paths 50*a*, 10*a*, and 30*a*. The bill discriminating unit 30 judges whether the bills passing through the bill discriminating unit 30 are bills that can be dispensed. When the bills can be dispensed, as the discrimination result, the bill distribution gate 13 is switched to be connected to the conveying path 10*d* and the conveying path 10*c*, such that the bills are accumulated in the bill accumulation portion 20*c*.

On the other hand, when the bills cannot be dispensed, as the discrimination result, the bill distribution gate 13 is switched to be connected the conveying path 10*d* and the conveying path 10*e*, and the conveying path is connected by the distribution gates 54 and 55 through the conveying paths 10*f* and 50*d*, such that the bills are conveyed to the reject box 60. The discrimination of bills and the control of switching the bill distribution gate 13 according to a result of the discrimination are completed while the bills are conveyed by the conveying path 10*d*.

When the operation for conveying the bills is finished, the shutter 20*a* of the bill receiving and dispensing port 20 is opened and the bills accumulated in the bill accumulating portion 20*c* can be extracted by the user. When the bills are extracted by the user, the action is detected by the sensor (not shown) and the shutter 20*a* is closed, and the dispensing transaction process is finished.

In the operations of the dispensing transaction process described above, the conveying paths 50*a*, 10*a*, 10*d*, 10*e*, 10*f*, and 30*a* of the first conveying path operate to convey the bills in the first conveying direction and the second conveying path 50*b* operates to convey the bills in the second conveying direction.

Further, when the bill storage box 74 is used as the reject box, the conveying path is switched by the bill distribution gate 54 and the bills that cannot be dispensed can be stored in the bill storage box 74.

Next, the operation of a loading process of bills is described with reference to FIG. 8.

The loading process is an operation to convey and store the bills from the loading box 70 to the bill storage boxes 71 to 73.

The bills fed one by one from the loading box 70 to the conveying path 70*a* is conveyed to the bill discriminating unit 30 sequentially through the conveying paths 50*b*, 10*f*, 10*e*, and 10*d*, and the denominations of bills and whether bills are deserved to be loaded are discriminated therein. After the discrimination, the bills are passed to the conveying paths 10*a* and 50*a* and are distributed by the bill distribution gates 51 to 53, which are switched according to denominations, and then stored in any one of the bill storage boxes 71 to 73.

In the operation of the loading process, the second conveying path 50*b* operate to conveys the bills in the first conveying direction and the conveying paths 10*f*, 10*e*, 10*d*, 30*a*, 10*a*, and 50*a* of the first conveying path operate to conveys the bills in the second conveying direction.

By the operation of the loading process, the bills fed from the loading box 70 are directly distributed to the bill storage boxes 71 to 73, without being temporarily stored in the temporary storage box.

Figure 9:
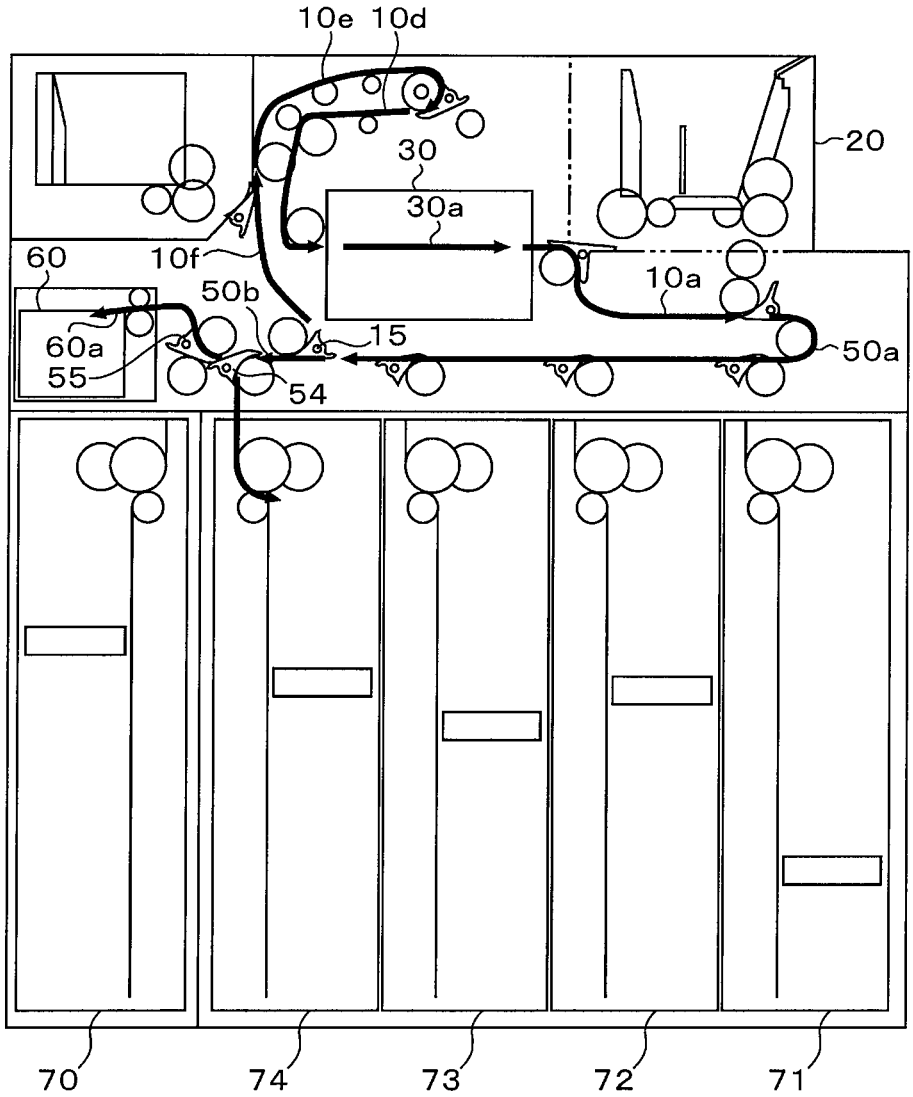
FIG. 9 is a view illustrating the operation of a rejection process in the operation of a bill loading process of bills in the bill handling apparatus.

Next, the operation of process when a bill is rejected in the loading process is described with reference to FIG. 9. This process is an operation to convey a bill, which is discriminated to be rejected (rejected bill) by the bill discrimination portion 30 to the reject box 60 or the bill storage box 74 (when this is used as the reject box).

The discrimination of bills by the bill discrimination portion 30 is completed while the bills are conveyed on the conveying path 10*a*. Once bills are discriminated to be rejected, the feeding of the bill from the loading box 70 is stopped. Thereafter, the bill on the conveying paths 70*a* and 50*b* is delivered to the conveying path 10*f*, and the conveying on the paths 70*a* and 50*b* are stopped when the bill is removed from the conveying paths 70*a* and 50*b*. After the conveying path 50*b* is stopped, the conveying direction of the conveying path 50*b* is switched to convey the bill to in the second direction. The bill distribution gate 15 is switched to connect the conveying path 50*a* with the conveying path 50*b* while changing the conveying direction of the conveying path 50*b*.

The conveying paths 10*a*, 10*d*, 10*e*, 10*f*, 30*a*, and 50*a* continue conveying the bills without stopping, between the switching of the conveying direction of the conveying path 50*b* and the switching of the bill distribution gate 15.

The switching of conveying direction of the conveying path 50*b* and the switching of the bill distribution gate 15 are completed while the bills discriminated to be rejected is conveyed on the conveying path 10*a*. The rejected bill is stored in the reject box 60 through the conveying paths 50*b* and 60*a*.

The denominations and suitability for loading of the bill conveyed after the rejected bill are discriminated by the bill discriminating unit 30, but when the bill is not discriminated to be rejected, it is distributed to the bill distribution gates 51 to 53 in accordance with the denominations of bill and stored in any one of the bill storage boxes 71 to 73. When the bills are discriminated to be rejected, it is stored in the reject box 60.

As soon as the bills that are conveyed on the conveying path are stored in the storage box of the storage destinations, the operation of feeding of the bills from the loading box 70 started again and the loading process is continued. When all of the bills or a predetermined number of bills in the loading box 70 are fed and stored in the storage boxes of the storage destinations, the loading process is completed.

Further, the reject box 60 may be used as a collecting box for storing the bills that the customer forgot to extract and the bill storage box 74 may be used for storing the rejected bills. In this case, the rejected bill is stored in the bill storage box 74 by changing the conveying path with the bill distribution gate 54.

An attendant can extract and collect the rejected bill from the ATM 101 when adding bills, without stopping the ATM 101, by taking out the reject box 60 storing the rejected bills from the rear side of the ATM 101.

As a modified embodiment, the bill storage box 74 may be used at a loading box, and in this case, the bills in the bill storage box 74 are conveyed back and stored in the storage boxes 71 to 73. That is, in the description above, the loading operation can be understood by substituting the bill storage box 74 for the loading box 70 and the conveying path 74*a* for the conveying path 70*a*. However, the bills discriminated to be rejected by the bill discriminating unit 30 are stored in the reject box 60 when the bills are loaded from the bill storage box 74 to the bill storage boxes 71 to 73.

Next, the operation of collecting process of bills is described with reference to FIG. 10.

The collecting process is an operation of process for collecting bills from the bill storage boxes 71 to 73 to the loading box 70. Collection of the bills is performed by conveying the bills fed from the bill storage boxes 71 to 73 to the bill discriminating unit 30 through the conveying paths 50*a* and 10*a* and then storing in the loading box 70 through the conveying paths 10*d*, 10*e*, 10*f*, 50*b*, and 70*a*. The bills discriminated to be rejected by the bill discriminating unit 30 are stored in the reject box 60 by changing the conveying path to the conveying path 60*a* with the bill distribution gate 55. Further, the bills discriminated to be rejected may be stored in the bill storage box 74 by changing the conveying path to the conveying path 74*a* with the bill distribution gate 54.

In the operation of collecting process, the conveying paths 10*a*, 10*d*, 10*e*, 10*f*, 30*a*, and 50*a* of the first conveying path operate to convey the bills in the first conveying direction and the second conveying path 50*b* operate to convey the bills in the second conveying direction.

Further, according to a modified embodiment, the bill storage box 74 may be used as a temporary loading box for collecting bills. In this case, the bill handling apparatus 1 is provided with two loading boxes of the loading box 70 and the bill storage box 74, such that it is possible to collect the bills to the two collecting boxes of the loading box 70 and the bill storage box 74, when collecting the bills, such that it is possible to collect the bills at a time in the ATM.

Next, the operation of a dispensing process is described with reference to FIG. 11.

The dispensing process is an operation for directly dispensing bills to the bill receiving and dispensing port 20 without loading the bills stored in the loading box 70 to the bill storage boxes 71 to 73. The dispensing process prevents the ATM from stopping due to a decrease of the bills and maintains the service for the customers, by stopping dispensing bills from the bill storage boxes 71 to 73, and directly dispensing the bills from the loading box 70, when the bills in the bill storage boxes 71 to 73 decreases to below a predetermined amount.

The bills fed one by one from the loading box 70 is conveyed to the bill discriminating unit 30 through the conveying paths 70*a*, 50*b*, 50*a*, and 10*a* and the bill discriminating unit 30 discriminates whether the bills conveyed to the bill discriminating unit 30 are bills that can be dispensed. When the bills are discriminated to be dispensed, the bill distribution gate 13 is switched to connect the conveying path 10*d* with the conveying path 10*c*, such that the bills are accumulated in the bill accumulating portion 20*c* through the conveying paths 10*d* and 10*c*.

In the operation of a process dispensing bills from the loading box, the conveying paths 10*a*, 10*d*, 10*e*, 30*a*, and 50*a* of the first conveying path and the second conveying path 50*b* operate to convey the bills in the first conveying direction.

Figure 12:
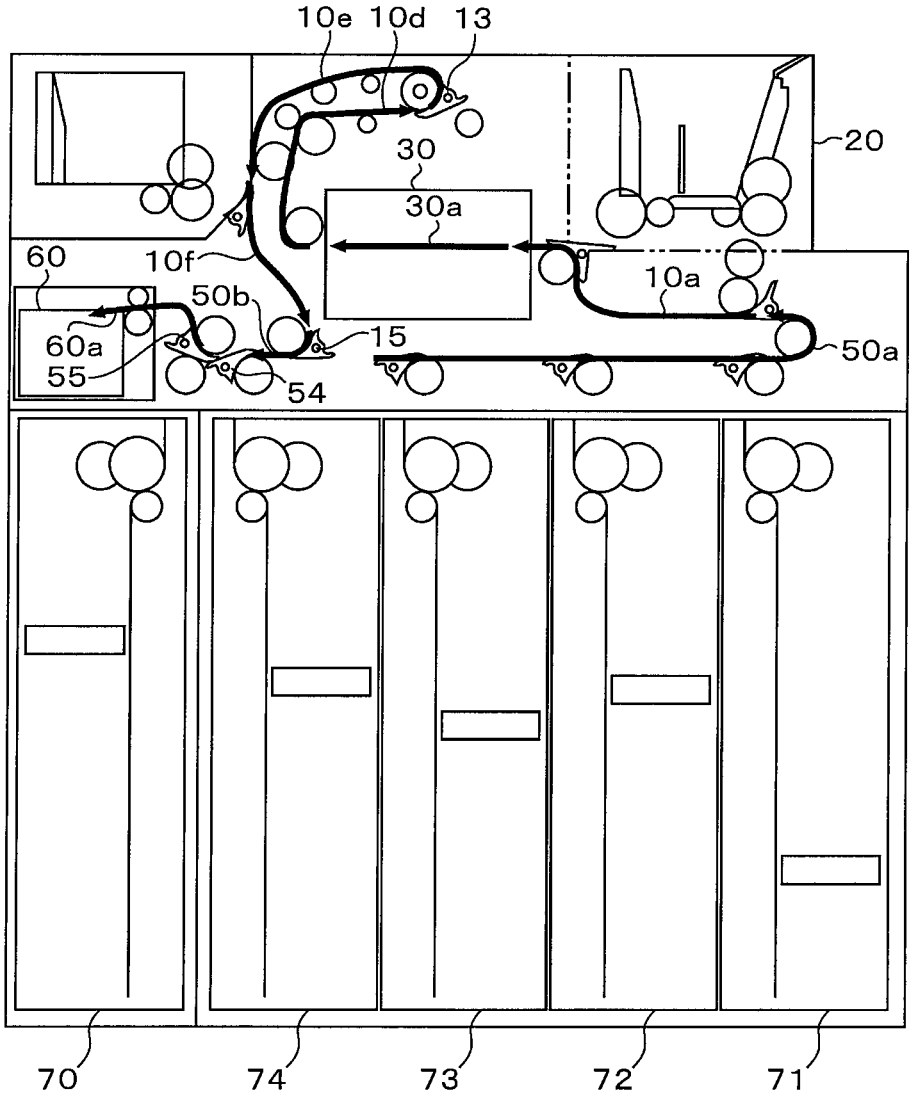
FIG. 12 is a view illustrating the operation of a rejection process in dispensing bill in the bill handling apparatus.

When the bills are discriminated not to be dispensed in discriminating the bills, as shown in FIG. 12, the bill distribution gate 13 is switched to connect the conveying path 10*d* with the conveying path 10*e*. The discriminating of dispensed bills and the switching of the bill distribution gate 13 according to a result of the discrimination are completed while the bills are conveyed on the conveying path 10*d*. Further, the bills discriminated not to be dispensed (rejected bills) are stored in the reject box 60 through the conveying paths 10*e*, 10*f*, 50*b*, and 60*a*.

Figure 7:
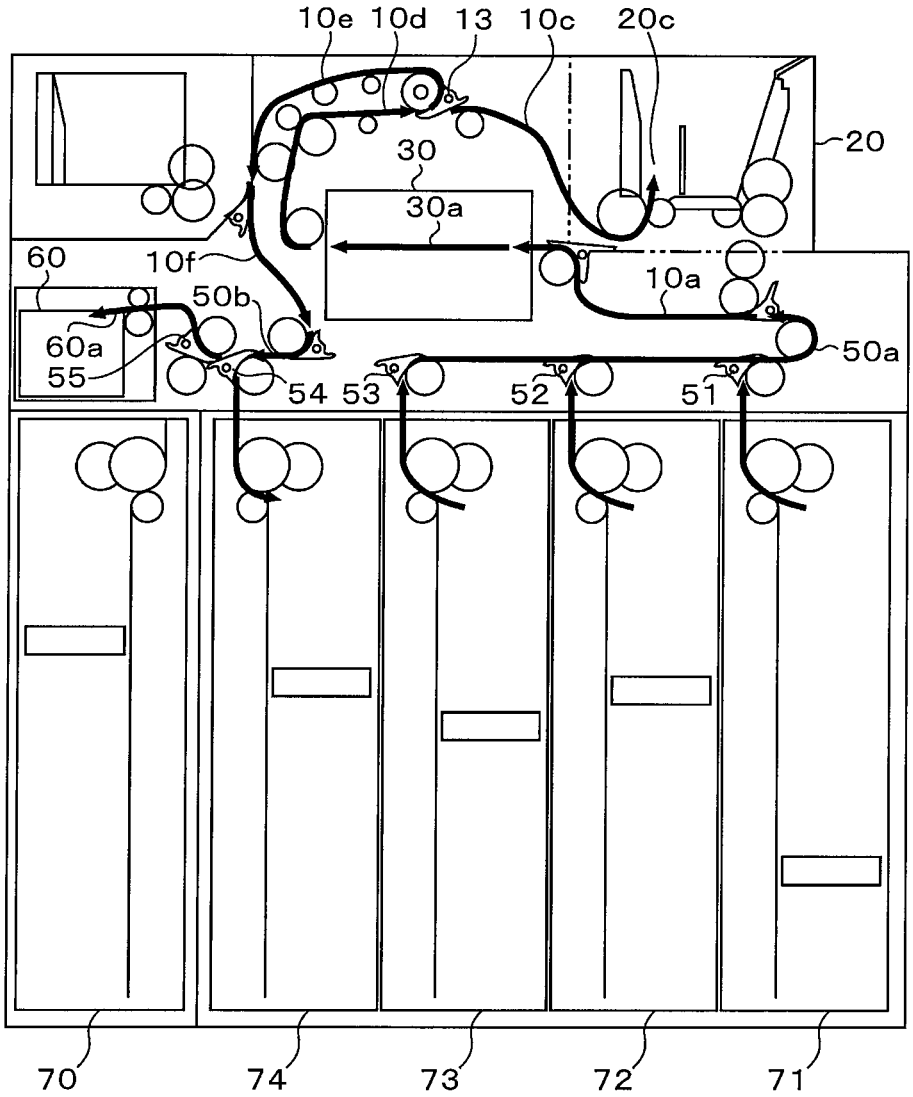
FIG. 7 is a view illustrating the operation of a dispensing process in the bill handling apparatus.

Further, as can be understood from the description above, the conveying paths and the conveying directions of the bills in the dispensing process from the loading box 70 are the same as the conveying paths and the conveying directions as in the dispensing process shown in FIG. 7, except for the boxes from which the bills are dispensed.

An operation of conveying rejected bills is described in more detail with reference to FIG. 12. Once bills are discriminated not to be rejected bills, the feeding of the bills from the loading box 70 is stopped. Thereafter, the conveyance on the conveying paths 70*a* and 50*b* is stopped when all of the bills on the conveying paths 70*a*, 50*b* pass and the bills are no longer on the conveying paths 70*a* and 50*b*. After the conveying path 50*b* is stopped, the conveying direction of the conveying path 50*b* is switched to convey the bills in the second conveying direction, and then the conveying path 50*b* is operated. The bill distribution gate 15 is switched to connect the conveying path 50*b* with the conveying path 10*f*, simultaneously with the switching of the conveying direction of the conveying path 50*b*. Further, the switching of conveying direction of the conveying path 50*b* and the switching of the bill distribution gate 15 are completed while the bills discriminated to be rejected are conveyed on the conveying paths 10*e*, 10*f*.

Further, the reject box 60 may be used as a left-behind bill collecting box for storing bills that the customer forgot to extract. In this case, the rejected bills may be stored in the bill storage box 74 by changing the conveying path with the bill distribution gate 54.

The loading box 70 can be detached from the rear side of the apparatus, without stopping the ATM. When the bills in the apparatus are completely dispensed or decreased, it is possible to dispense the bills directly from the loading box 70 in a short time, without distributing and loading bills to the bill storage boxes 71 to 73, by mounting the loading box 70 that stores bills in the bill handling apparatus 1.

As another embodiment, the bill storage box 74 may be used as a loading box, and in this case, the bills are fed from the bill storage box 74 to the conveying path by switching the bill distribution gate 54. The next conveying operation of bills is the same as the above. Further, the bills fed from the bill storage box 74, that is, the bills discriminated to be rejected by the bill discriminating box 30 are stored in the reject box 60.

By the operation described above, it is possible to directly convey the bills, which are discriminated to be rejected and not suitable to be stored in the bill storage boxes 71 to 74, to the reject box 60 or the bill storage box 74, without temporarily storing the bills in the temporary storage unit 40 or the bill receiving and dispensing port 20 and the like, thereby reducing the process time of the apparatus.

When bills are rejected in the operation of dispensing bill from the loading box, the conveying paths 10*d*, 10*e*, and 10*f* of the first conveying path convey the bills in the second conveying direction and the second conveying path 50*b* reverses conveying direction of bills from the first conveying direction to the second conveying direction.

Figure 13:
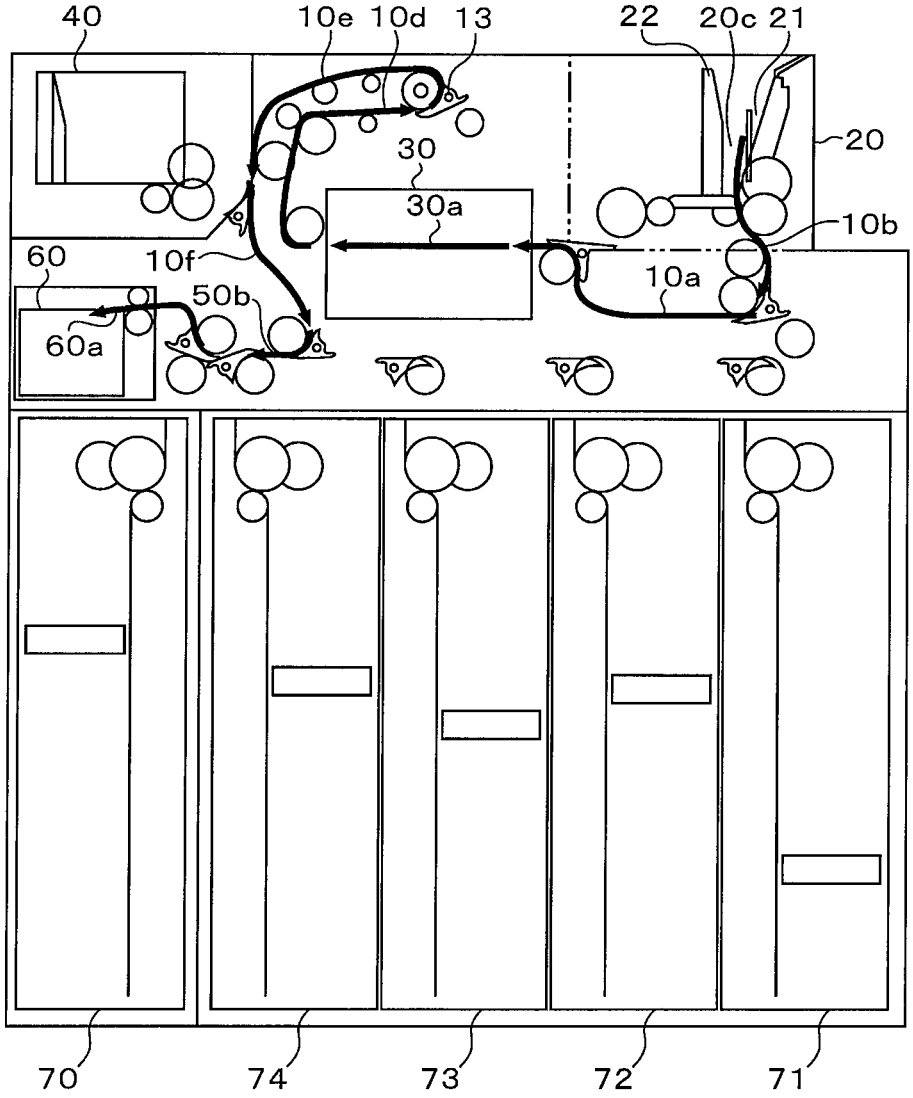
FIG. 13 is a view illustrating the operation of a collecting process of bills left behind in the bill handling apparatus.

Next, the operation of a returning process of bills left behind is described with reference to FIG. 13.

The collecting process is an operation of returning bills dispensed from the bill receiving and dispensing port 20 that the user forgot to extract into the reject box 60 (or the bill storage box 74).

The bills that are dispensed from the bill accumulating portion 20*c* and left behind are pushed by a pressing plate 22 in the bill accumulating portion 20 and moved to the front side of the bill receiving and dispensing port, and then fed to the conveying path 10*b* one by one. The bills are stored in the reject box 60 through the conveying paths 10*a*, 30*a*, 10*d*, 10*e*, 10*f*, 50*b*, and 60*a*.

Further, as another embodiment, the bills left behind may be stored in the bill storage box 74 through the conveying path 74*a* after passing the conveying path 50*b*.

In the operation of collecting process of the bills left behind, the conveying paths 10*a*, 30*a*, 10*d*, 10*e*, 10*f* of the first conveying path convey the bills in the first conveying direction and the second conveying path 50*b* conveys the bills in the second conveying direction.

Figure 14:
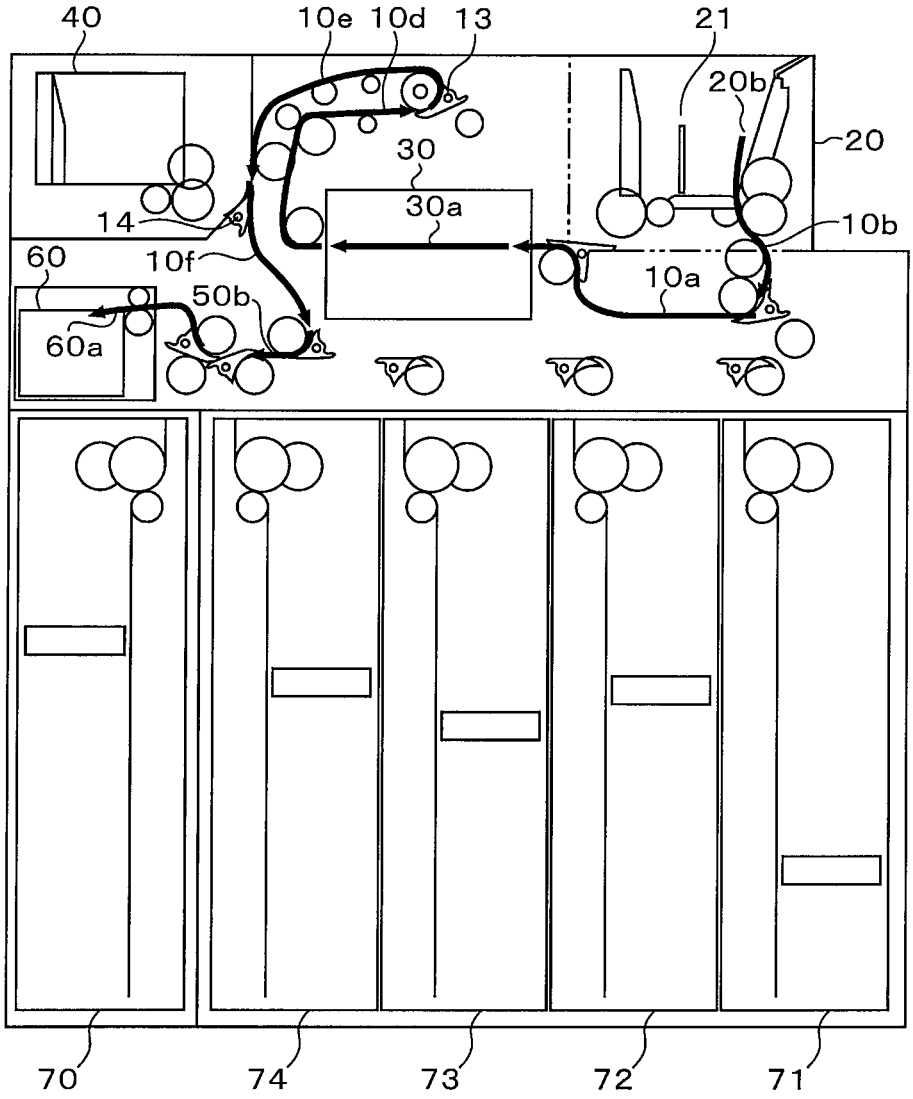
FIG. 14 is a view illustrating the operation of a collecting process of received bills in a bill handling apparatus.

Next, the operation of collecting process of received bills according to another embodiment is described with reference to FIG. 14.

Figure 5:
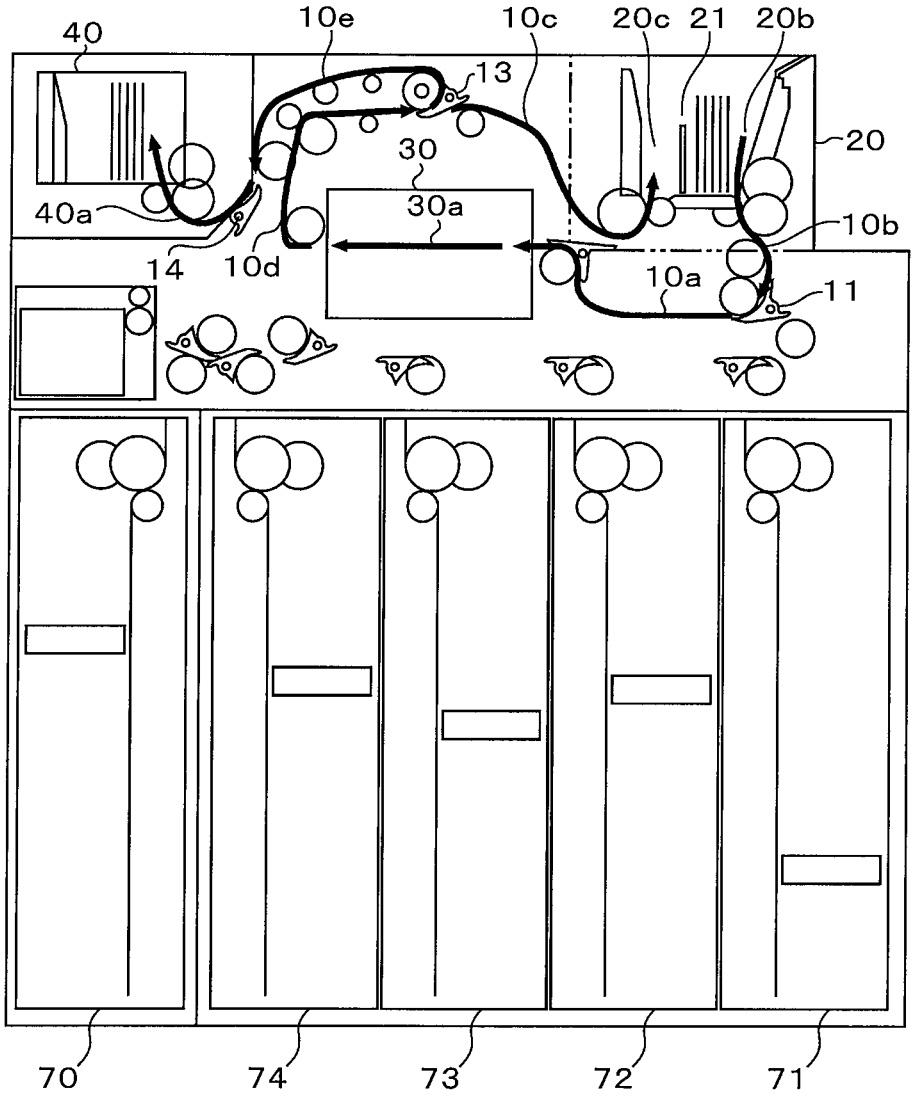
FIG. 5 is a view illustrating the operation of a receipt transaction process in the bill handling apparatus.

In the embodiment shown in FIG. 5, bills that are discriminated as recirculation-unsuitable bills, such as counterfeit bills, by the bill discriminating unit 30 in the receipt counting process are temporarily stored in the temporary storage unit 40 by switching the bill distribution gate 14. According to the modified embodiment, the recirculation-unsuitable bills may be stored in the reject box 60 through the conveying paths 10*d*, 10*e*, 10*f*, 50*b*, and 60*a* without being stored in the temporary storage unit 40. Further, the switching of bill distribution gate 14 is completed while the bills are conveyed on the conveying path 10*d*.

In the operation of collecting process of received bills using the reject box 60, the conveying paths 10*a*, 30*a*, 10*d*, 10*e*, and 10*f* of the first conveying path convey the bills in the first conveying direction and the second conveying path 50*b* conveys the bills in the second conveying direction.

As described above, according to the embodiments described above, it is possible to make the conveying path simple, not in the 8-shaped conveying route of the related art, because the conveying path connected to the two-way conveying path 50*b* is provided at the end of the conveying path and the bill receiving and dispensing port 20, temporary storage unit 40, reject box 60, loading box 70, and bill storage boxes 71 to 74 are connected to the conveying path, even though the temporary storage unit 40 is arranged in the rear upper end upper part of the apparatus, the reject box 60 is arranged in the middle part, and the loading box 70 is arranged in the lower part while bills are conveyed in any one of the first conveying direction and the second conveying direction on the two-way conveying paths 10*a*, 10*d*, 10*e*, 10*f*, and 50*a* which connect the components with the bill discriminating unit 30. Therefore, it is possible to make the conveying path simple and implement a small-sized bill handling apparatus having large capacity.

Figure 19:
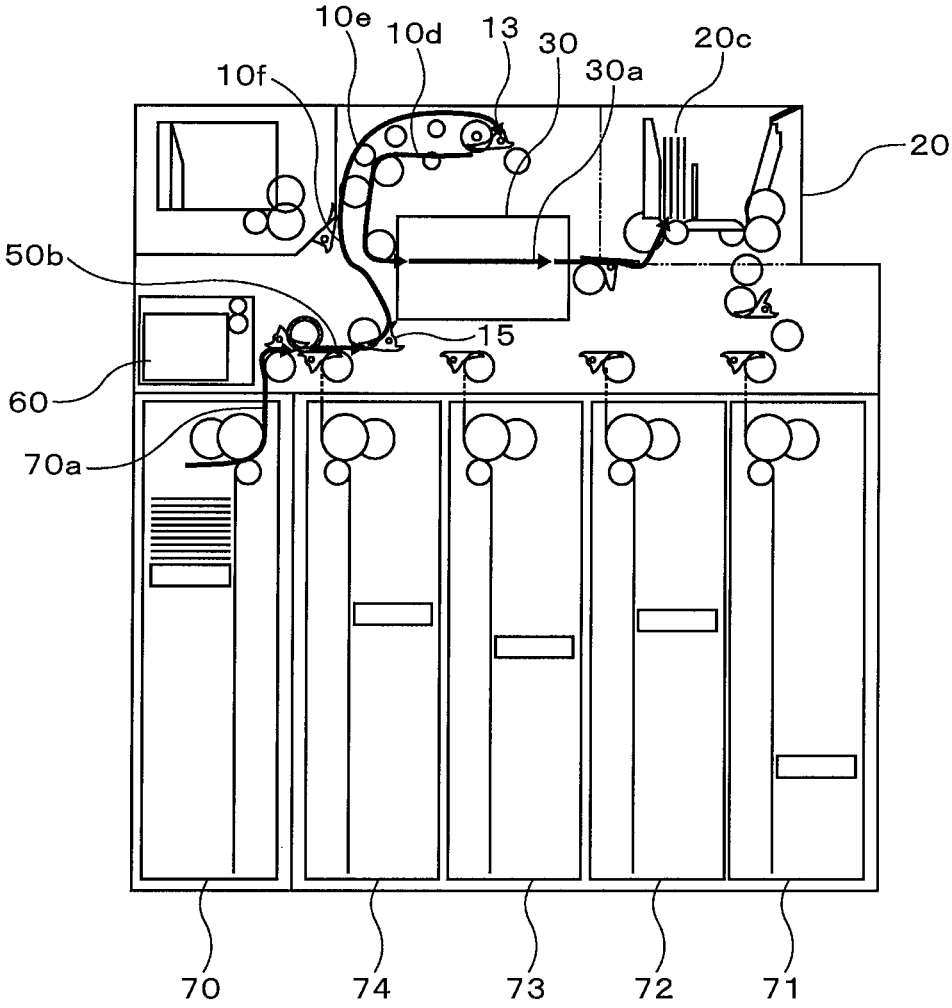
FIG. 19 is a view illustrating the operation of a dispensing process in a bill handling apparatus.

Further, according to this embodiment, it is possible to provide a new bill conveying path for a bill dispensing process. The embodiment is a modified example of the dispensing process shown in FIG. 7 (dispensing bills from the bill storage boxes 71 to 73) or in FIG. 11 (dispensing bills from the loading box 70), as shown in FIG. 19. The dispensing process (third dispensing route) shown in FIG. 19 can be implemented by the above dispensing process, in addition to the dispensing process (first dispensing route) shown in FIG. 7 and the dispensing process (second dispensing route (substantially the same as the first dispensing route)) shown in FIG. 11. For example, when trouble such as a jamming of the bills occurs on the conveying path (e.g. conveying paths 50*a* and 10*a*) which is the first dispensing route, it is possible to dispense bills from the loading box 70 by replacing the conveying path by the third dispensing route, such that it is possible to prevent the ATM from running out of operation by the trouble on the conveying path.

Referring to FIG. 19, the bills fed from the loading box 70 is discharged to the bill receiving and dispensing port 20 through the conveying paths 10*f*, 10*e*, and 10*d* and the bill discriminating unit 30 (first two-way conveying path), by changing the conveying direction with the bill distribution gate 15 through the conveying path 50*b* (second two-way conveying path).

Figure 11:
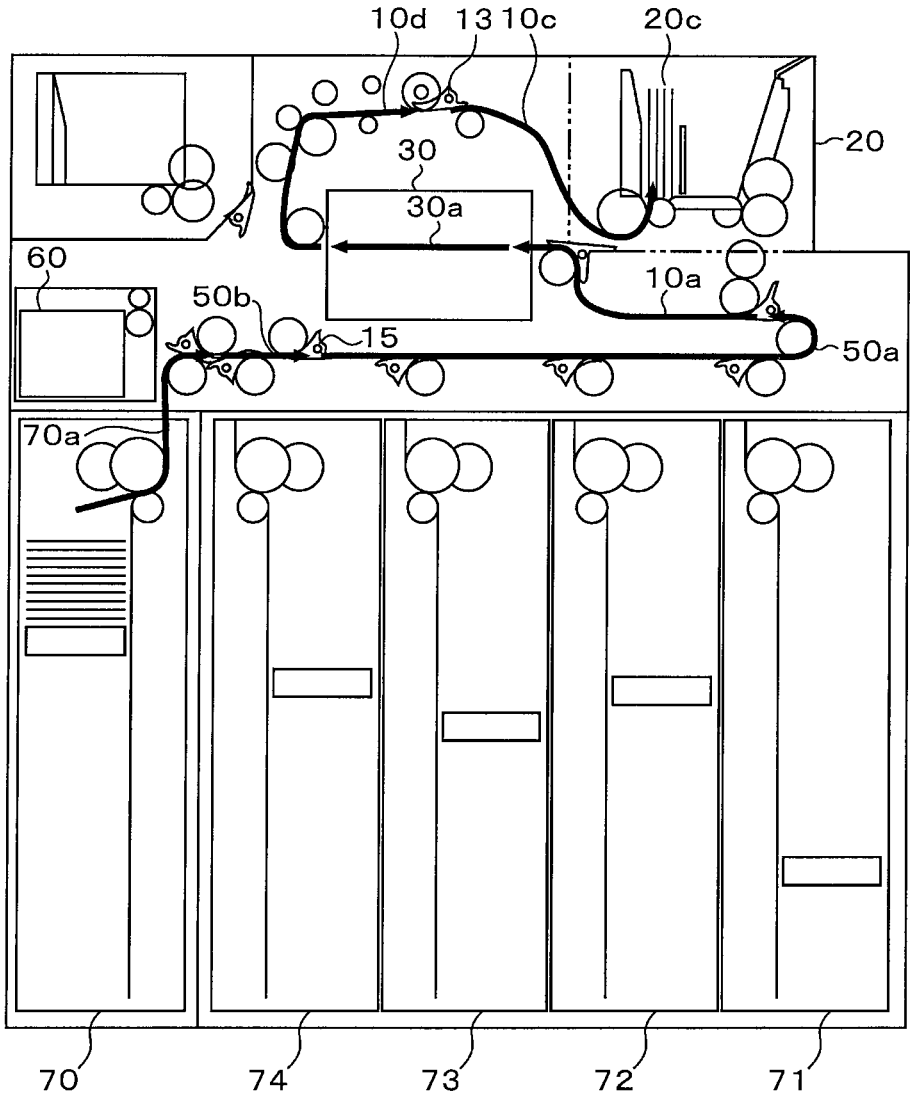
FIG. 11 is a view illustrating the operation of a dispensing process in the bill handling apparatus.

Comparing the dispensing through the third dispensing route with the dispensing through the second conveying path shown in FIG. 11, the bills do not pass the conveying path 50*a* and 10*a* of the first two-way conveying path and they are conveyed in different directions in the first two-way conveying path. Further, according to the dispensing operation by the third dispensing route, it is possible to minimize the number of bill distribution gates to pass in the conveying path and reduce the conveying distance.

In the dispensing process, the path which is used to convey the bills is changed by the controller 16 shown in FIG. 16. That is, the main control unit 161 generally monitors detection signals from the detecting sensor 165 mounted in the conveying path. While being monitored, when the main control unit 161 determines based on the detection signals from any one of the detecting sensors that there is a problem in the conveying path, it stops the driving motor 166 of the conveying path with a corresponding detecting sensor and switches the bill distribution gate 15 to switch the conveying path to another conveying path without a problem. For example, when bills are dispensed from the storage boxes 71 to 73 and it is determined there is a problem in the conveying path 50*a* or 10*a* (first dispensing route and the second dispensing route), the main control unit 161 switches the bill distribution gate 15 to dispense the bills from the loading box 70. The bills fed from the loading box 70 are discharged to the bill receiving and dispensing port 20 through the conveying path 50*b* (second two-way conveying path), conveying paths 10*f*, 10*e*, and 10*d*, and bill discriminating unit 30.

Thus, it is possible to dispense bills, using the third dispensing route, not the conveying path with a problem, when the conveying path on the first dispensing route or the second dispensing route has a problem.

Figure 8:
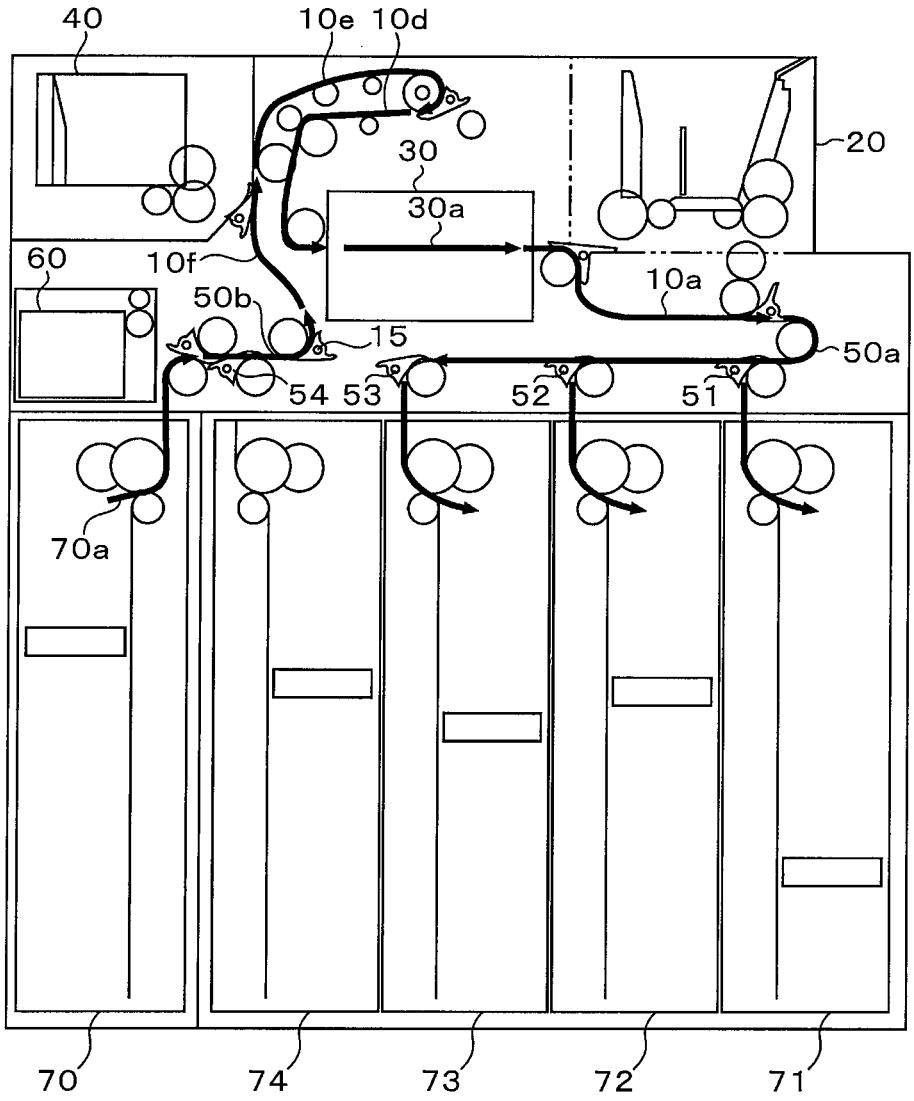
FIG. 8 is a view illustrating the operation of a bill loading process of bills in the bill handling apparatus.
Figure 10:
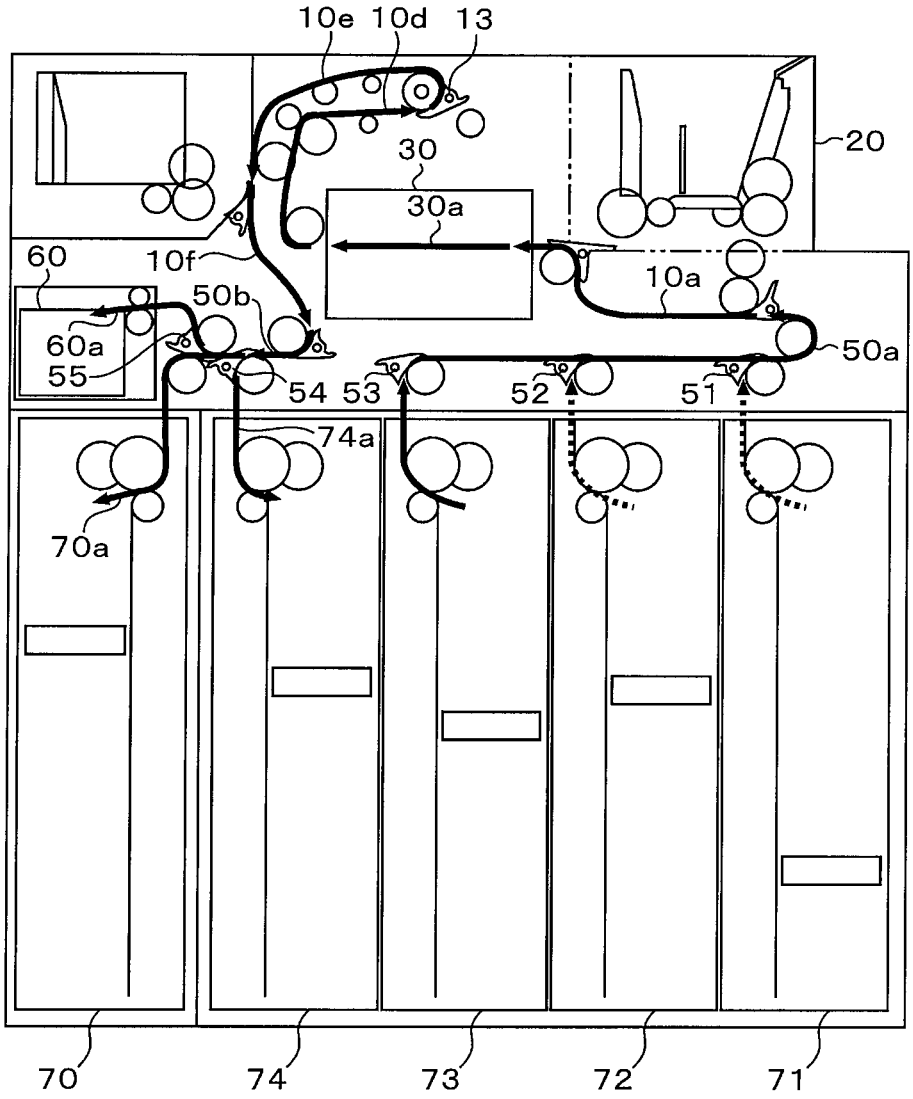
FIG. 10 is a view illustrating the operation of a collecting process of bills in the bill handling apparatus.

As described above, according to an embodiment of the present invention, it is possible to move bills, that is, load or collect bills, with high reliability, at high speed between the bill loading portion and the bill storage portion (examples shown in FIGS. 8 and 10). Further, since a plurality of conveying paths for dispensing are provided (examples shown in FIGS. 7, 11, and 19), it is possible to implement a convenient ATM having high operability.

What is claimed is:

1. A bill handling apparatus for handling received and dispensed bills, comprising:

a bill receiving and dispensing port configured to receive bills for receipt and to accumulate bills discharged for dispensing;

a bill discriminating unit configured to discriminate truth and denominations of the received and dispensed bills;

a temporary storage unit configured to temporarily store bills discriminated by the bill discriminating unit;

a plurality of bill storage boxes configured to store bills;

a loading box configured to store bills that are added to the bill storage boxes or to collect and store bills conveyed from the bill storage boxes;

a first looped conveying path that passes through the bill discriminating unit, is connected to the bill receiving and dispensing port, the temporary storage unit, and to the plurality of bill storage boxes at the outer side of the loop to convey bills in two directions in a bidirectional manner;

a second conveying path connected to between the first loosed conveying path and the loading box at the outer side of the first looped conveying path to convey bills in two directions;

a first gate, arranged in the first looped conveying path, that connects the first looped conveying path with the second conveying path and is configured to switch a conveying direction of the conveying path that conveys bills;

a plurality of detecting sensors that are arranged at least in the first looped conveying path and are configured to detect a conveying state of bills;

a controller configured to control at least switching of the first gate and conveyance of the conveying path;

a first dispensing route configured to discharge bills fed from the bill storage boxes to the bill receiving and dispensing port through the bill discriminating unit by conveying the bills on the first looped conveying path in one of the two directions; and a second dispensing route configured to discharge the bills fed from the loading box to the second conveying path to the bill receiving and dispensing port through the bill discriminating unit by conveying the bills on the first looped conveying path in the other of the two directions via the first gate, not through the conveying path part connected with the bill storage box, wherein the controller is configured to monitor detection signals from the plurality of detecting sensors, determine a problem in conveying the bills on the first looped conveying path, and control the first dispensing route or the second dispensing route to be selected in accordance with the determination result.

2. The bill handling apparatus according to claim 1, wherein the loading box is arranged with the plurality of bill storage boxes in a line forward from a rear side of the bill handling apparatus.

3. The bill handling apparatus according to claim 1, wherein the controller is configured to control the bills conveyed on the first looped conveying path in one of the two directions to be conveyed to the loading box through the second conveying path via the first gate and to control the bills conveyed from the loading box through the second conveying path to be conveyed to the first looped conveying path in one of the two directions via the first gate.

4. The bill handling apparatus according to claim 1, further comprising:

a reject box configured to store rejected bills discriminated to be rejected by the bill discriminating unit; and a second gate configured to switch a conveying destination in the second conveying path to convey bills to one of the reject box and the loading box, wherein the rejected bills conveyed on the first looped conveying path are conveyed to the second conveying path via the first gate, and conveyed to the reject box via the second gate.

5. The bill handling apparatus according to claim 4, wherein when bills temporarily stored in the temporary storage unit are stored in the plurality of bill storage boxes, the controller is configured to control the bills to be discriminated by the bill discriminating unit while conveying the bills on the first looped conveying path in one direction, and when a bill is rejected by the discrimination result, the controller is configured to control the rejected bill to be conveyed to the first looped conveying path in the one direction, and to be conveyed to the reject box through the first gate and the second conveying path, and when bills are dispensed from the plurality of bill storage boxes, the controller is configured to control the bills fed from the plurality of bill storage boxes to be discriminated by the bill discriminating unit while conveying the bills on the first looped conveying path in the opposite direction to the one direction, and when a bill is rejected by the discrimination result, the controller is configured to control the rejected bill to be conveyed on the first looped conveying path in the opposite direction, and to be conveyed to the reject box through the first gate and the second conveying path.

6. The bill handling apparatus according to claim 1, wherein the first looped conveying path is branched by a third gate to be connected to the bill receiving and dispensing port, at one side of the bill discriminating unit, branched by a fourth gate to be connected to the temporary storage unit, and then connected to the second conveying path via the first gate.

7. The bill handling apparatus according to claim 1, further comprising another bill storage box connected to the second conveying path and arranged side by side with the loading box.

8. The bill handling apparatus according to claim 1, wherein the controller is configured to control bills fed from the bill storage boxes to be conveyed to the loading box through the first gate and the second conveying path, without storing the bills to the temporary storage unit, after passing through the bill discriminating unit in the first looped conveying path, and to control bills fed from the loading box to the second conveying path to be conveyed to the first looped conveying path via the first gate, and conveyed to the plurality of bill storage boxes, without storing the bills to the temporary storage unit, after passing through the bill discriminating unit.

9. The bill handling apparatus according to claim 1, comprising a tray accommodating the loading box arranged in a rear side of the apparatus and the plurality of bill storage boxes arranged ahead of the loading box, wherein the tray may be drawn backward from the apparatus by separating the second conveying path from the first looped conveying path.

* * * * *